United States Patent [19]

Johansson et al.

[11] Patent Number: 4,526,654

[45] Date of Patent: Jul. 2, 1985

[54] APPARATUS FOR CONTROL OF THE SLICE OPENING ON A SLICE LIP ON A HEADBOX

[75] Inventors: Bengt Å. Johansson, Skellefteå; Peter Brodin, Mellerud, both of Sweden

[73] Assignee: AccuRay Corporation, Columbus, Ohio

[21] Appl. No.: 522,523

[22] Filed: Aug. 12, 1983

[30] Foreign Application Priority Data

Aug. 13, 1982 [SE] Sweden ..... 8204698

[51] Int. Cl.[3] ..... D21F 1/02; D21C 1/06

[52] U.S. Cl. ..... 162/259; 162/347; 414/751; 414/753

[58] Field of Search ..... 162/252, 253, 259, 262, 162/263, 198, 347; 414/753, 751, 749

[56] References Cited

U.S. PATENT DOCUMENTS 2,951,007 8/1960 Lippke .
3,422,967 1/1969 Aron ..... 414/573
3;463,701 8/1969 Curtis ..... 162/347

FOREIGN PATENT DOCUMENTS 2372929 8/1978 France ..... 162/259

OTHER PUBLICATIONS

Sponaugle, Harold E., "Automatic Profile Gauge Control," *SPE Journal*, Jun. 1963, pp. 561-564.

*Primary Examiner*—Steve Alvo
*Attorney, Agent, or Firm*—C. Henry Peterson

[57] ABSTRACT

A device for control of the slice opening of a slice on a headbox contains several jackscrews that are distributed along and act against the control lip of the slice. A first carriage is moveable along a first track that is parallel to the row of jackscrews. A second carriage runs on a track on the first carriage in direction across the first track. The second carriage contains a drive motor that has a gripping device. By means of control devices and driving devices, the carriages are controlled so that the gripper in sequential order can mate with the drive shaft ends of the jackscrews for adjustment of the profile of the control lip and distance from the fixed slice lip by means of the drive motor.

8 Claims, 4 Drawing Figures

APPARATUS FOR CONTROL OF THE SLICE OPENING ON A SLICE LIP ON A HEADBOX

TECHNICAL FIELD

This invention relates to an apparatus for control of the slice opening on a paper machine headbox, using a plurality of jackscrews that are evenly distributed across the width of the slice for acting on the control lip of the slice. More particularly the invention relates to such an apparatus having a gripping device adapted for temporary connection to any one of the jackscrews in order to effect its adjustment, and a remotely controlled device for locating the gripping device in operating position next to any desired one of the jackscrews.

BACKGROUND ART

The slice opening on a headbox in a paper machine defines the thickness of stock that flows out onto the wire. The slice arrangement normally has a fixed slice member and a controlled slice member. A number of jackscrews (for example 50–60) are mounted in a way and distributed in a row across the width of the machine. The jackscrews act against the control lip. By adjustment of the jackscrews the control lip can be changed to adjust the basis weight of the sheet and/or the profile in the cross machine direction. The sheet that is formed and dried in the machine is measured at several points in the cross machine direction. The measurement results can be utilized to adjust the slice screws in corresponding positions, so that the basis weight profile for the stock that flows onto the wire can be optimized, in partiular for cross machine profile control.

The jackscrews are typically only adjustable by hand. Each jackscrew may comprise a simple adjustment screw with very fine threads. Since it is desirable to reduce personnel costs and also to be able to more quickly adjust the slice lip, it is known to equip each jackscrew with a separate reducer (gearbox) and motor that is remotely controlled, whereby the control can be achieved automatically. This may be done, for example with the guidance of the basis weight profile of the dried paper, in order to adjust the profile of the stock layer going onto the wire. In this way the dried paper sheet can be optimized for bone dry weight profile, the moisture profile of the sheet can be leveled, and the drying requirements can be minimized.

Automation of the slice lip adjustment in that manner, however, has several disadvantages. The large number of drive motors and the labor of installing them is costly, and additionally it has been found that the reliability may be degraded. This is because there is a cumulative risk of malfunction that may occur in any one of the large number of drive motors and/or gearboxes, especially in view of the fact that some individual drive motors are only very sporadically energized. An object of this invention is therefore to avoid these named disadvantages by providing an apparatus for control of the jackscrews that adjust the slice opening on a slice on a headbox by acting on the control lip, which apparatus is connected to a remote control arrangement that can itself be controlled in a conventional way.

DISCLOSURE OF INVENTION

This invention relates to an apparatus for control of the slice lip opening on a slice lip on a headbox. The apparatus involves a plurality of jackscrews that are distributed across, and act against, the slice control lip, and is characterized in particular by a gripping device arranged for temporary connection to any of the jackscrews, a drive mechanism for driving the jackscrews using the gripping device, and a positioning device arranged to move the gripping device to mate with any one of the jackscrews. Control devices are arranged to move the positioning device so as to connect to a selected slice screw and to control the driving device for desired adjustment of the jackscrew that is temporarily connected to the gripping device. The positioning device advantageously includes a first track that goes across the row of jackscrews, a first carriage that is moveable across the first track, a first device for moving the first carriage across the track, a second track that is perpendicular to the first track, a second carriage that is moveable across the second track, a second device for positioning the second carriage along the second track, and the gripping device is supported by the second carriage.

Each jackscrew can involve a rotatable drive shaft, in which case the gripping device would preferrably also be rotatable and coaxially arranged so as to be able to grip on the end of the drive shaft.

The gripping device may comprise several hinged levers, each having two arms, one of which is a chucking device for interaction with the circumference of the end piece of the shaft and the other is arranged to face inwardly toward the axis of the gripping device rotating shaft and adapted for interaction with the end of the shaft. The second arm of the lever is spring loaded against the free end of the gripping device, so that the chuck jaws are caused to diverge when the gripping device is unloaded.

The end part of the jackscrew shaft may have a particular surface, coaxial with the rotation axis of the shaft, equipped with external finely spaced axial ribs that alternately provide sharp peaks, and the chuck jaws may each have at least one sharp peak for interaction with the ribs.

The end part of the shaft can with advantage be connected to the rest of the shaft over a universal joint. The jackscrew can with advantage be of conventional design and include a manual adjustment knob or handwheel on its shaft, whereas the mentioned end point of the shaft is designed as a separate unit, coaxially mounted with the handwheel. The jackscrews are suitably mounted with their drive shafts in an open plane in which the gripping device central axis lies, while the shaft of the gripping device should be parallel with the drive shafts of the jackscrews. The driving device is preferably mounted on the second carriage and includes a rotatable shaft on which the gripping device is coaxially mounted.

The invention will now be described in more detail in connection with a non-limiting example and with reference to the attached drawings.

BEST MODE FOR CARRYING OUT THE INVENTION

Figure 1:
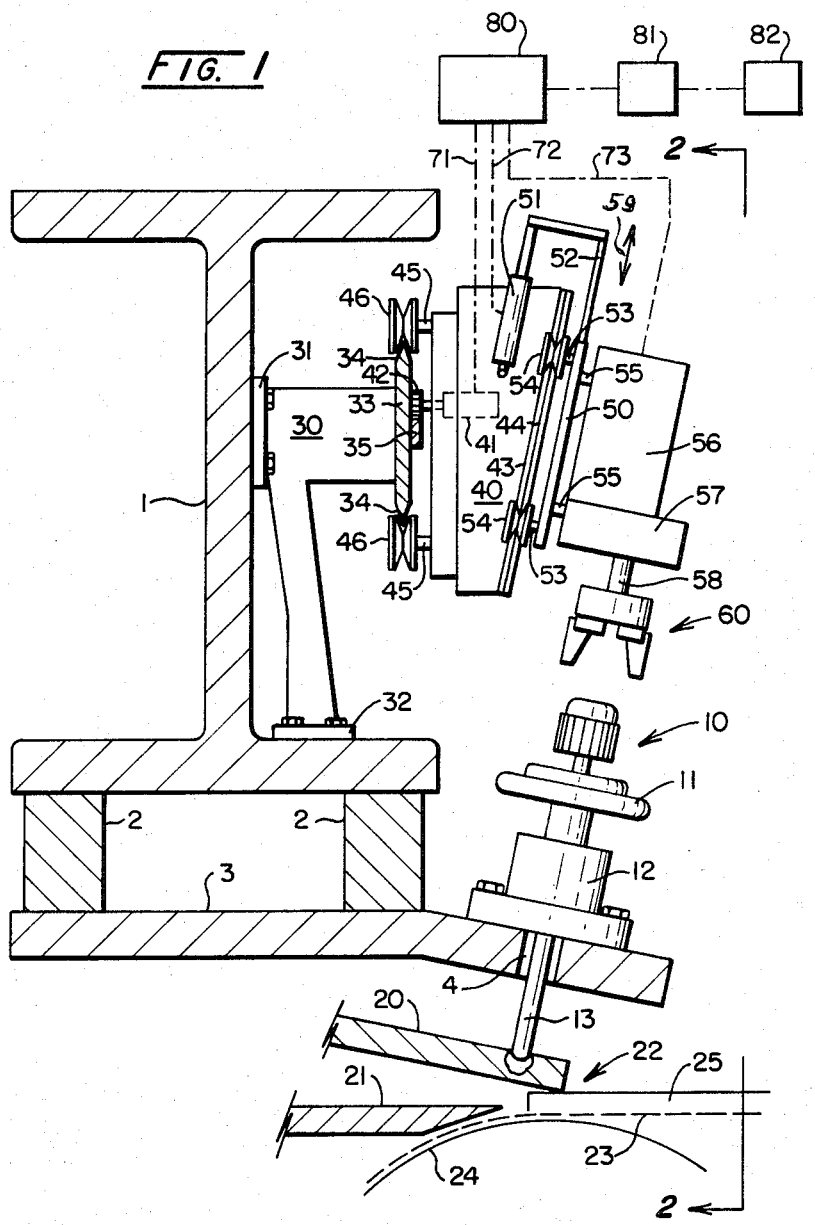
FIG. 1 shows schematically a partially cross-sectioned view from the side of an apparatus according to the invention.

At the bottom of FIG. 1 is shown a controlled slice lip 20 and a fixed lip 21, which are parts of the slice arrangement on a paper machine headbox. The slice lips define a slit or opening 22, through which stock is flowing onto a wire 23 that runs over a breast roll 24. The free end of control lip 20 can be adjusted toward or away from the wire by means of a rod 13 that is freely moving through an opening 4 in the sheet metal part 3. The rod 13 is adjustable by a jackscrew 12. The piece of sheet metal 3 is supported by mounting ribs 2 on a beam 1 that stretches across the whole width of the machine.

Brackets 30 are with their flanges 31, 32 attached to the beam 1 for example with bolts. The brackets 30 support a way 33 that extends entirely across the beam 1. The way 33 supports upper and lower knife edges 34, that are parallel. On the right side in FIG. 1 the way 33 has a rack 35 attached. A first carriage 40 has four shafts 45 that each carry a free running wheel 34, such that the carriage 40 can be moved with good precision along the way 33.

The carriage 40 has a drive motor 41 with an attached rotatable sprocket wheel 42 that normally runs on the rack 35 in order to effect traversing of the carriage 40 along the way 33.

The carriage 40 carries a way 43 that is oriented essentially perpendicular to the way 33, and includes two parallel knife edges 44 that form a track for a carriage 50. The carriage 50 has shafts 53 that have attached free running wheels 54 with a profile corresponding to that of the knife edges 44, so that the carriage 50 can be moved with good precision and stability on the way 43. A drive motor 51 is mounted on the carriage 40 and acts with a bar 52 against the carriage 50 to cause movement of the latter in the direction of the arrow 59. The carriage further has a device 55 for coupling on a drive motor 56, that via a gearbox 57 and an outgoing shaft 58 is attached to a rotatable gripper 60. The slice control lip 20 can be arranged to be actuated by a large number, for example 55, jackscrews 12 that are arranged on the sheet metal part 3 across the whole machine width.

Figure 2:
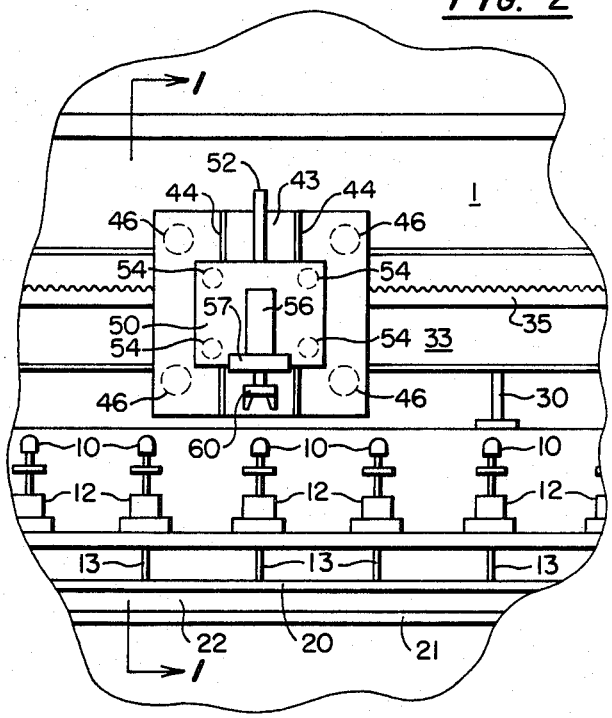
FIG. 2 shows a view taken along the line 11—11 in FIG. 1.

With reference to FIGS. 1 and 2, the apparatus operates according to the following. Sensing devices 82 that measure the basis weight profile of the dried product in the cross-machine direction, provide signals to a computer 81 that processes the signals and gives control directions to a controller 80. The controller, via the cables 71, 72, 73, will cause the gripper 60 to sequentially find the jackscrews 10 by suitable driving of the motors 41 and 51, and will also control the drive motor 56 via the cable 73 such that the gripper 60 rotates the shaft 10 in a desired amount for desired local control of the slice lip 20.

The equipment 80 to 82 for control of the apparatus according to this invention can be of conventional technology.

Even if the carriages 40, 50 and their wheels 44, 54 and ways 33, 43 are made with high precision, and in addition utilize precision drive of the carriages, it can easily happen that the gripper 60 is not perfectly centered relative to the shaft end 10 of the jackscrew 12. Because of that, the shaft end 10 can be arranged according to FIG. 4, where the illustrated design can be achieved with a universal joint between the driving shaft end 10 and the main part of the shaft.

Figure 4:
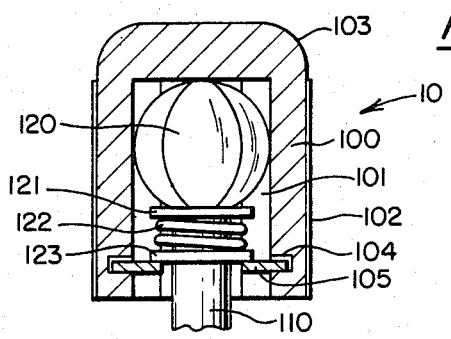
FIG. 4 shows a partially cross-sectioned view of the end part of the shaft of the jackscrew that is used for gripping.

In FIG. 4 is shown a shaft end 110 that carries a ball 120 with hexagonal cross section across the direction of the shaft end 110. The ball is tightly fit in a hexagonal cavity 101 in a cap 100. The shaft end 110 carries two washers 121, 123 between which a compression spring 122 is compressed. The washer 123 rests on a lock ring 105 that is inserted in a groove 104 inside the cap 100 at the end. In the shown design, the cap 100 can have angular movement relative to the direction of shaft end 110. The cap 100 has on its outside surface axial ribs 102, and the external end 103 of this part is rounded to a convex shape.

Figure 3:
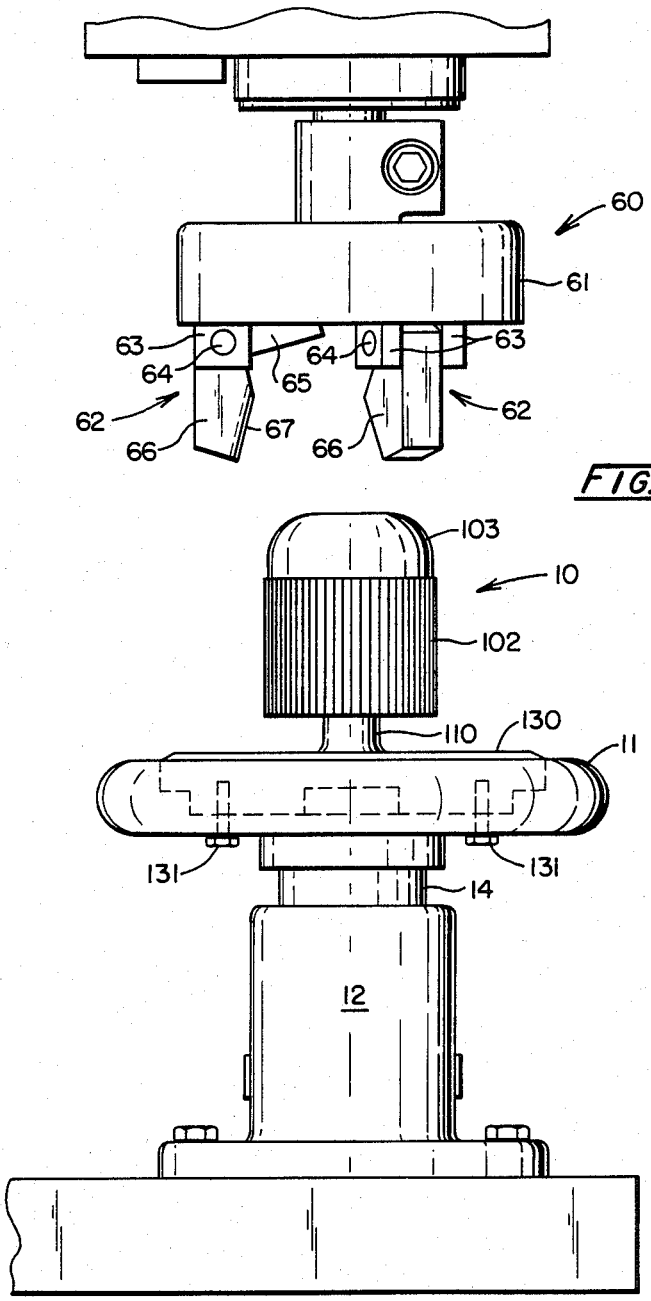
FIG. 3 shows a side view, in enlarged scale, of a detail in the apparatus according to FIG. 1.

With reference to FIG. 3, the shaft end 110 is fixedly connected to a base plate 130 that fits into the hub space on the conventional handwheel 11 on the jackscrew 12. The base plate 130 is fixed to the wheel 11 by bolts 131, so that the jackscrews 12 can be moved without the drive motor 56 if desired. With respect to the upper part of FIG. 3, the gripper 60 consists of a base plate 61 with three different pairs of protrusions 63, in which a shaft 64 is secured. A lever 62 is arranged in a free-moving fashion on each shaft 64. Each lever 62 has a first arm 65 and a second arm 66 that are arranged with an angle in between, where the arm 65 principally is oriented radially in towards the rotational axis of the gripping jaw 60. A tensioning device (not shown), for example in the form of an O-ring that is coaxial with the rotational axis of the gripping jaw 60 and working against the arms 65 in order to achieve a force along the rotational axis, will bring the arms 66 to the position shown. The arms 66 are in addition designed to act as grippers in order to actuate the shaft end 10 of the jackcrew 12. For this purpose, the arms 66 have on their inwardly facing surfaces ribs 67 that correspond to the ribs 102 on the end piece 10. The ribs 67 are arranged in such a way that they diverge in direction towards the free end of the gripper 60 under influence of the tensioning device.

When the drive motor 41 has brought the gripper 60 to a position coaxial with the shaft end 10, the motor is controlled such that the gripper 60 will be brought over the shaft end 10, with guidance from the diverging gripper surfaces 67.

When the end part 10 via its outer part 103 is brought in contact with the arms 65, the grippers 66 are pressed into a distinctive contact with the surface 102 because of the coaction between the ribs. Potential misalignment between the gripper 60 and its end part 10 is normally caused by backlash in the support of the carriages 40, 50 and is thus absorbed by these when the gripper 60 mates with the end piece 10.

In order to align the axis of the gripper 60 with the jackscrew shaft 14, the first carriage 40 must be accurately positioned across the first track. For this purpose, it is desirable to use one or several magnetic sensors that are connected for example to a microcomputer for sensing of the position of position locator bolts of a ferromagnetic material. In this case, a positioning locator bolt is arranged for example on the first track in each position that corresponds to a common axis between the gripping device with the shaft 14 when the sensor will sense the bolt by a change in magnetic field. By this, the drive motor on the first carriage can guide the gripping device to coaxial arrangement with a pre-selected shaft 14 in response to a remote control signal that only generally indicates the selected jackscrew.

Preferrably, there are extra magnetic sensors on each side of each position transducer, where the extra sensors act to reduce the motor speed on the first carriage in the near proximity of the selected jackscrew so that positioning can be made more accurately at the position transducer.

What is claimed is:

1. Apparatus for controlling the opening of the slice of a headbox, comprising a plurality of jackscrews that are distributed across and act against the control lip of the slice, each jackscrew having a rotatable driving shaft, a gripping device arranged for temporary connection to any one of the jackscrews, the gripping device being rotatable and arranged to coaxially grip the end part of the particular driving shaft, the gripping device comprising a plurality of hinged levers each having two arms, of which one is a gripping jaw for interaction with the periphery of the end part on the driving shaft and the other is directed in towards the axis of the gripping device to achieve joint action with the end of the driving shaft, a tensioning means for working against the second arm to urge it in the direction towards the free end of the gripping device so that the gripping jaws diverge in the direction towards the free end of the gripping device in its unloaded state, a remotely controlled drive mechanism for driving the particular jackscrew via the gripping device, and a remotely controlled positioning device arranged to move the gripping device to connect to any one of the jackscrews, the positioning device including a first carriage which supports a second carriage for the gripping device and the drive mechanism, the first carriage allowing movement of the gripping device to a position in axial alignment with and axially spaced from the end part of the driving shaft of any one of the jackscrews, the second carriage allowing axial movement of the gripping device from the axially spaced position into a position for gripping engagement with the end part of the driving shaft, whereby the end part of the shaft forces the second arms of the gripping device away from the free end of the gripping device, thereby causing the first arms of the gripping device to converge on the driving shaft and grip the periphery of the same in order to effect its rotation.

2. Apparatus according to claim 1 wherein the end piece of the driving shaft has a surface coaxially arranged with the driving shaft, the surface having axially extending ribs, and the gripping jaws each having at least one rib for interaction with the surface ribs.

3. Apparatus according to claim 1 wherein the end piece of the driving shaft is a separate piece that is coaxially mounted on a conventional handwheel on the main shaft of the jackscrew for manual operation of the jackscrew.

4. Apparatus according to claim 1, wherein the end piece of the driving shaft is attached to the main shaft by an universal joint.

5. Apparatus according to claim 1, wherein the positioning device comprises a first track that stretches along the row of jackscrews, the first carriage being movable along the first track, a first device for moving the first carriage along the first track, a second track that is arranged on the first carriage across the first track, the second carriage being movable along the second track and, a second device for moving the second carriage along the second track, the gripping device being supported by the second carriage.

6. Apparatus according to claim 5, wherein the driving device is mounted on the second carriage and includes a rotatable shaft on which the gripping device is coaxially mounted.

7. Apparatus according to claim 5, wherein bolts of a ferromagnetic material are arranged along the first track, one bolt being aranged at each slice screw, and wherein a magnetic sensing device on the first carriage is arranged to sense the position for a jackscrew by the corresponding bolt, whereby the sensing device is arranged to control the drive motor of the first carriage for alignment of the gripping device with the corresponding shaft.

8. Apparatus according to claim 1, wherein the jackscrews are mounted with their main shafts parallel and in a plane which coincides with the shaft of the gripping device and the shaft of the gripping device is parallel with the main shafts of the jackscrews.

* * * * *